US012607191B2

(12) United States Patent
Edmunds et al.

(10) Patent No.: US 12,607,191 B2
(45) Date of Patent: Apr. 21, 2026

(54) BLOWER ASSEMBLY FOR HVAC SYSTEM

(71) Applicant: Johnson Controls Light Commercial IP GmbH, Neuhausen am Rheinfall (CH)

(72) Inventors: Randal H. Edmunds, Norman, OK (US); Steven M. Maddox, Elmond, OK (US); Leonie Oehm Packard, Oklahoma City, OK (US); David Woodward, Norman, OK (US); William M. Harris, Norman, OK (US); John Loyd McElvany, Norman, OK (US); Alec Barker, Oklahoma City, OK (US); Kevin Manh Cao, Oklahoma City, OK (US); Jed David Rimmer, Newcastle, OK (US); Jeffery B. Russler, Chickasha, OK (US); Sumedh Suryawanshi, Norman, OK (US); Michael Anthony Williams, Moore, OK (US); Randall W. Thurman, Newcastle, OK (US); Samuel Hembree, Milwaukee, WI (US)

(73) Assignee: Johnson Controls Light Commercial IP GmbH, Shaffhausen (CH)

( * ) Notice: Subject to any disclaimer, the term of this patent is extended or adjusted under 35 U.S.C. 154(b) by 0 days.

(21) Appl. No.: 18/827,396

(22) Filed: Sep. 6, 2024

(65) Prior Publication Data

US 2025/0075705 A1 Mar. 6, 2025

Related U.S. Application Data

(60) Provisional application No. 63/536,900, filed on Sep. 6, 2023.

(51) Int. Cl.
*F04D 25/06* (2006.01)
*F04D 27/00* (2006.01)
(Continued)

(52) U.S. Cl.
CPC ..... *F04D 25/06* (2013.01); *F04D 27/004* (2013.01); *F04D 29/281* (2013.01); *F04D 29/624* (2013.01)

(58) Field of Classification Search
CPC ..... F04D 25/06; F04D 27/004; F04D 29/281; F04D 29/624
See application file for complete search history.

(56) References Cited

U.S. PATENT DOCUMENTS 5,000,160 A * 3/1991 Dunlop ..... F24C 15/2042 126/299 R
8,210,806 B2 * 7/2012 Yang ..... F04D 25/12 415/206
(Continued)

FOREIGN PATENT DOCUMENTS

KR 20060034107 A * 4/2006 ..... F24F 7/08

OTHER PUBLICATIONS

English Translation KR-20060034107-A (Year: 2006).*

*Primary Examiner* — Shafiq Mian
(74) *Attorney, Agent, or Firm* — Kelly McGlashen

(57) ABSTRACT

A heating, ventilation, and air conditioning (HVAC) system includes a fan wheel, a motor directly coupled to the fan wheel and configured to drive rotation of the fan wheel, and an enclosure. The enclosure includes a first side panel, a second side panel, and a curved panel extending from the first side panel to the second side panel to define an internal volume of the enclosure. The first side panel includes an air inlet opening formed therein, the second side panel includes a main panel and a cover panel configured to removably couple to the main panel, the main panel includes an opening and a slot formed therein, the motor is configured to be disposed at least partially within the opening and to mount to the second side panel in an assembled configuration of the blower assembly, the cover panel is configured to occlude
(Continued)

the slot in the assembled configuration, and the motor and the fan are removable from the enclosure via the slot.

18 Claims, 10 Drawing Sheets

(51) Int. Cl.
*F04D 29/28* (2006.01)
*F04D 29/62* (2006.01)

(56) References Cited

U.S. PATENT DOCUMENTS

2005/0042078 A1* 2/2005 Sturgell ..... F04D 29/4226 415/128
2013/0064660 A1* 3/2013 Hong ..... F04D 29/282 415/206
2019/0316597 A1* 10/2019 Brendel ..... F04D 29/30

* cited by examiner

BLOWER ASSEMBLY FOR HVAC SYSTEM

CROSS-REFERENCE TO RELATED APPLICATIONS

This application claims priority from and the benefit of U.S. Provisional Application No. 63/536,900, entitled "FAN UNIT," filed Sep. 6, 2023, which is herein incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and air conditioning (HVAC) systems are utilized in residential, commercial, and industrial environments to control environmental properties, such as temperature, humidity, and/or air quality, for occupants of the respective environments. HVAC systems may regulate environmental properties of environments via delivery of a conditioned air flow to the environment. For example, the HVAC system may generally include a fan or blower that is operable to direct an air flow across one or more heat exchange components of the HVAC system. As such, the blower may facilitate transfer of thermal energy between the heat exchange components and the air flow to generate the conditioned air flow for delivery to a suitable space within a building or other structure serviced by the HVAC system. The fan or blower may also drive flow of the conditioned air flow out of an HVAC unit and toward the space. Unfortunately, it may be arduous and cumbersome to access traditional fan and blower systems for maintenance, inspection, or other purposes.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to a blower assembly for a heating, ventilation, and air conditioning (HVAC) system including an enclosure having a curved panel, a first side panel attached to the curved panel, and a second side panel attached to the curved panel, where the curved panel, the first side panel, and the second side panel cooperatively define an air flow outlet of the blower assembly. The blower assembly further includes a fan wheel disposed within the enclosure and a motor mounted to the second side panel, where the motor includes a shaft, and the fan wheel is directly mounted to the shaft. The blower assembly further includes a base frame coupled to the enclosure. The base frame is configured to translate along a platform of the HVAC system to transition the blower assembly from an uninstalled configuration to an installed configuration, and the base frame is configured to engage with the platform to retain an orientation of the blower assembly within the HVAC system in the installed configuration.

The present disclosure also relates to blower assembly for a heating, ventilation, and air conditioning (HVAC) system having a fan wheel, a motor directly coupled to the fan wheel and configured to drive rotation of the fan wheel, and an enclosure. The enclosure includes a first side panel, a second side panel, and a curved panel extending from the first side panel to the second side panel to define an internal volume of the enclosure. The first side panel includes an air inlet opening formed therein, the second side panel includes a main panel and a cover panel configured to removably couple to the main panel, the main panel includes an opening and a slot formed therein, the motor is configured to be disposed at least partially within the opening and to mount to the second side panel in an assembled configuration of the blower assembly, the cover panel is configured to occlude the slot in the assembled configuration, and the motor and the fan are removable from the enclosure via the slot.

The present disclosure further relates to a heating, ventilation, and air conditioning (HVAC) system having a housing defining an air flow path therethrough, a platform disposed within the housing, where the platform includes a guide rail attached to a support surface of the platform, and a blower assembly configured to be disposed within the housing. The blower assembly includes an enclosure, a fan wheel disposed within the enclosure, and a motor directly coupled to the fan wheel and mounted to the enclosure. The enclosure includes a curved panel, a first side panel attached to the curved panel, a second side panel attached to the curved panel, and a side rail attached to the second side panel, and the side rail includes a retention flange. The blower assembly is configured to translate in a linear direction and along the platform from an uninstalled configuration to an installed configuration within the housing and atop the support surface of the platform, the retention flange is configured to translate within and along a retention slot of the guide rail, in the linear direction, during transition of the blower assembly from the uninstalled configuration to the installed configuration, and the guide rail is configured to engage with the retention flange to restrict movement of the enclosure of the blower assembly within the housing in the installed configuration.

BRIEF DESCRIPTION OF DRAWINGS

Various aspects of this disclosure may be better understood upon reading the following detailed description and upon reference to the drawings in which.

DETAILED DESCRIPTION

Figure 1:
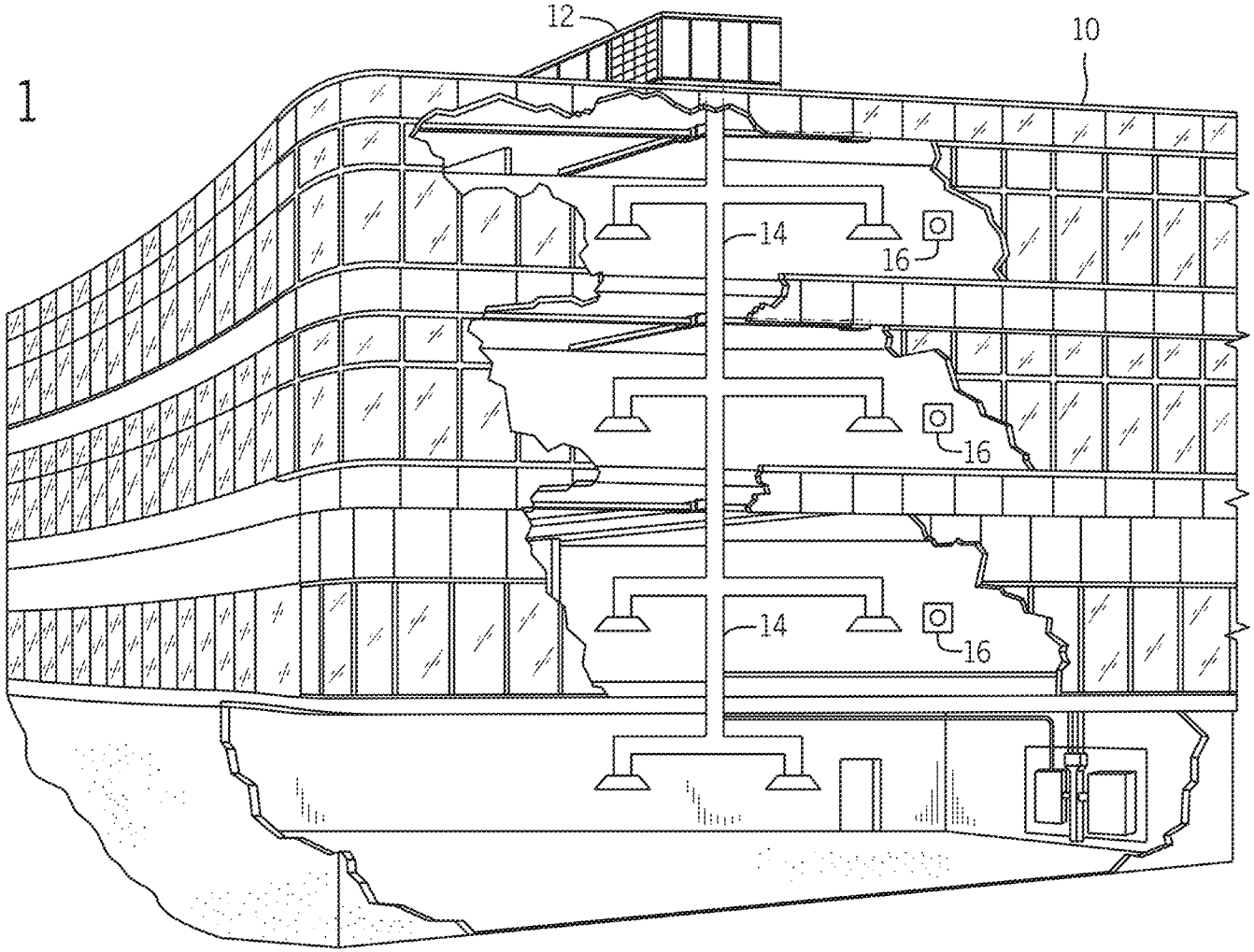
FIG. 1 is a perspective view of an embodiment of a building incorporating a heating, ventilation, and/or air conditioning (HVAC) system in a commercial setting, in accordance with an aspect of the present disclosure.

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "approximately," "generally," and "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to mean that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to mean that the given feature is within +/−5%, within +/−4%, within +/−3%, within +/−2%, within +/−1%, or even closer, to having the described nature, such as being parallel to another feature, being perpendicular to another feature, and so forth. Further, it should be understood that mathematical terms, such as "planar," "slope," "perpendicular," "parallel," and so forth are intended to encompass features of surfaces or elements as understood to one of ordinary skill in the relevant art, and should not be rigidly interpreted as might be understood in the mathematical arts. For example, a "planar" surface is intended to encompass a surface that is machined, molded, or otherwise formed to be substantially flat or smooth (within related tolerances) using techniques and tools available to one of ordinary skill in the art. Similarly, a surface having a "slope" is intended to encompass a surface that is machined, molded, or otherwise formed to be oriented at an angle (e.g., incline) with respect to a point of reference using techniques and tools available to one of ordinary skill in the art.

As briefly discussed above, a heating, ventilation, and/or air conditioning (HVAC) system may be used to thermally regulate a space within a building, home, or other suitable structure. For example, the HVAC system may include a vapor compression system that transfers thermal energy between a working fluid (e.g., a heat transfer fluid), such as a refrigerant, and a fluid to be conditioned, such as air. The vapor compression system includes heat exchangers (e.g. a condenser, an evaporator) that are fluidly coupled to one another via one or more conduits to form a working fluid circuit. A compressor may be used to circulate the working fluid through the working fluid circuit and enable the transfer of thermal energy between components of the vapor compression system (e.g., condenser, evaporator) and one or more thermal loads (e.g., an environmental air flow, a supply air flow).

Generally, the HVAC system includes a blower (e.g., a fan) that is configured to direct air across heat exchange components of the HVAC system and/or along an air distribution system (e.g., ductwork) of the HVAC system. Unfortunately, traditional blowers are often difficult to access and frequently involve full or partial extraction and/or removal of the blowers from an enclosure (e.g., air handling unit enclosure, duct, etc.) of the HVAC system, which may be arduous and time consuming. For example, traditional blowers may be coupled to an enclosure or other support structure of the HVAC system using a plurality of fasteners (e.g., screws) that are located in areas or regions of the enclosure that may be difficult or infeasible for a service technician to access without first removing and/or disassembling other components of the HVAC system that may be positioned adjacent to the blower. As a result, it may be difficult for a user (e.g., a service technician) to perform maintenance, inspection, or other tasks on the blower upon installation of the blower in the enclosure of the HVAC system Moreover, conventional blowers may include numerous components that contribute to increased costs and/or inefficient operation of the HVAC system. For example, conventional blowers may include belts, pulleys, and/or other power transmission components that transfer mechanical energy from a motor to a fan wheel of the blower. Such components may increase time and costs associated with manufacture and assembly of the blower, may cause reduced efficiency of the blower, and/or may cause increased power consumption of the HVAC system. Additional components incorporated with the blower may also result in less reliable operation of the blower.

It is now recognized that maintenance, installation, removal, and other operations on the blower may be facilitated and improved by enabling removal and/or replacement of the blower without disassembly and/or removal of other HVAC system components that may be adjacent to the blower. Facilitating maintenance, installation, removal, and other operations on the blower may reduce a time period between non-operational periods of the HVAC system (e.g., such as while maintenance is performed on the blower), which may improve an overall efficiency of the HVAC system and/or may reduce costs associated with HVAC system maintenance. Moreover, it is now recognized that reducing incorporation of additional components, such as power transmission components, with the blower may enable more efficient operation of the blower, as well as reduced time and cost expenditures associated with manufacture, assembly, installation, operation, and maintenance of the blower. Embodiments incorporating the disclosed techniques may also enable more efficient operation of the blower, reduced energy consumption, improved serviceability of the blower, and other benefits.

Accordingly, embodiments of the present disclosure are directed toward a blower assembly having a blower and a motor configured to directly drive rotation of the blower. For example, the blower may be a backward curved fan, and/or the motor may be an electronically commutated motor (ECM). To this end, the motor may be directly coupled or mounted to the blower (e.g., fan wheel). The blower assembly also includes a housing configured to support the blower and the motor. In some embodiments, the motor may be directly mounted to the housing. The blower assembly may also be configured to be more readily installed within, and removed from, an HVAC unit. For example, a section or region within the HVAC unit configured to accommodate the blower assembly may be accessible via a removable panel of the HVAC unit. The blower assembly may also be configured to enable improved installation and removal of the blower assembly from the HVAC unit. For example, the blower assembly may include one or more mounting rails configured to engage with one or more corresponding guide brackets of the HVAC unit to enable proper positioning of the blower assembly within the HVAC unit, as well as retention of the blower assembly in an installed orientation or configuration within the HVAC unit. With a reduced number of components, such as a reduced number of power transmission components, incorporated with the blower assembly, the blower assembly may be more readily installed within, and removed from, the HVAC unit with simplified and improved maneuverability. These and other features will be described below with reference to the drawings.

Turning now to the drawings, FIG. 1 illustrates an embodiment of a heating, ventilation, and/or air conditioning (HVAC) system for environmental management that employs one or more HVAC units in accordance with the present disclosure. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12 with a reheat system in accordance with present embodiments. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a vapor compression cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one vapor compression circuit configured to operate in different modes. In other embodiments, the HVAC unit 12 may include one or more vapor compression circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
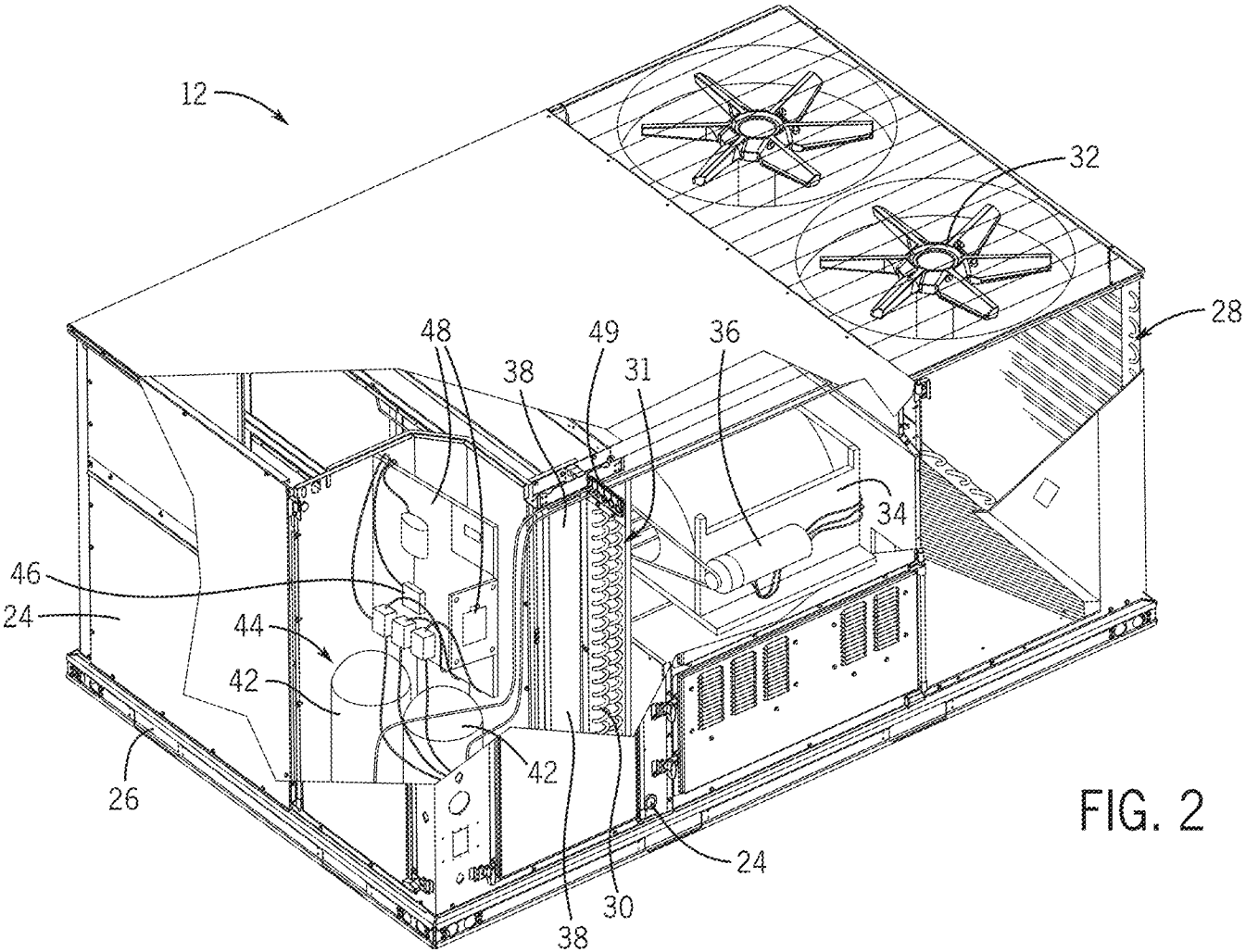
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent vapor compression circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more vapor compression circuits. Tubes within the heat exchangers 28 and 30 may circulate a working fluid, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the working fluid undergoes phase changes and/or temperature changes as it flows through the heat exchangers 28 and 30 to produce heated and/or cooled air. For example, the heat exchanger 28 may function as a condenser where heat is released from the working fluid to ambient air, and the heat exchanger 30 may function as an evaporator where the working fluid absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the working fluid before the working fluid enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
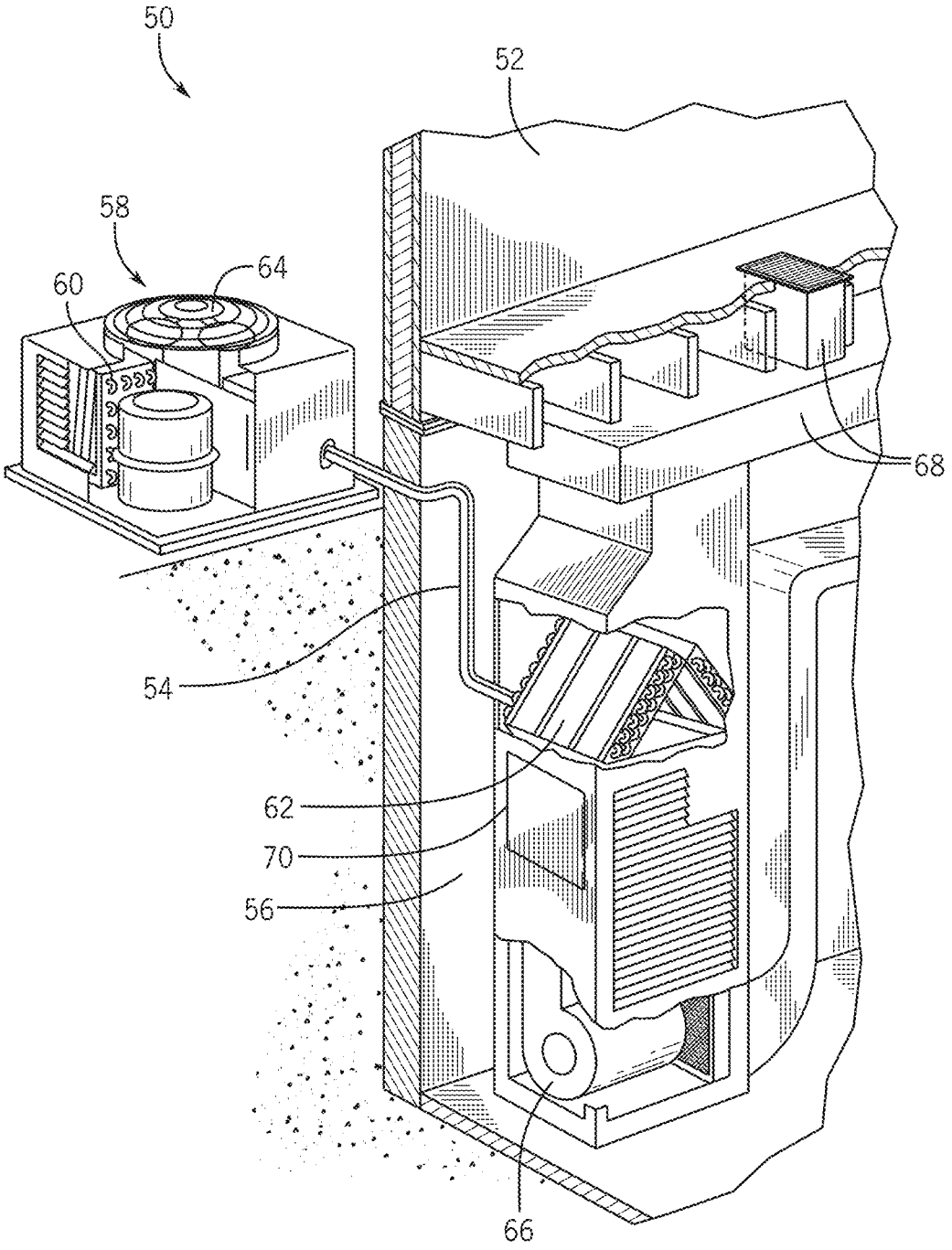
FIG. 3 is a perspective view of an embodiment of a split, residential HVAC system, in accordance with an aspect of the present disclosure.

FIG. 3 illustrates an embodiment of a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include working fluid conduits 54 that operatively couple the indoor unit 56 to the outdoor unit 58. The indoor unit 56 may be positioned in a utility room, an attic, a basement, and so forth. The outdoor unit 58 is typically situated adjacent to a side of the residence 52 and is covered by a shroud to protect the system components and to prevent leaves and other debris or contaminants from entering the unit. The working fluid conduits 54 transfer working fluid between the indoor unit 56 and the outdoor unit 58, typically transferring primarily liquid working fluid in one direction and primarily vaporized working fluid in an opposite direction.

When the system shown in FIG. 3 is operating as an air conditioner, a heat exchanger 60 in the outdoor unit 58 serves as a condenser for re-condensing vaporized working fluid flowing from the indoor unit 56 to the outdoor unit 58 via one of the working fluid conduits 54. In these applications, a heat exchanger 62 of the indoor unit functions as an evaporator. Specifically, the heat exchanger 62 receives liquid working fluid, which may be expanded by an expansion device, and evaporates the working fluid before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to cool additional air for circulation through the residence 52. When the temperature reaches the set point, or the set point minus a small amount, the residential heating and cooling system 50 may stop the vapor compression cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate working fluid and thereby cool air entering the outdoor unit 58 as the air passes over the outdoor heat exchanger 60. The indoor heat exchanger 62 will receive a stream of air blown over it and will heat the air by condensing the working fluid.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
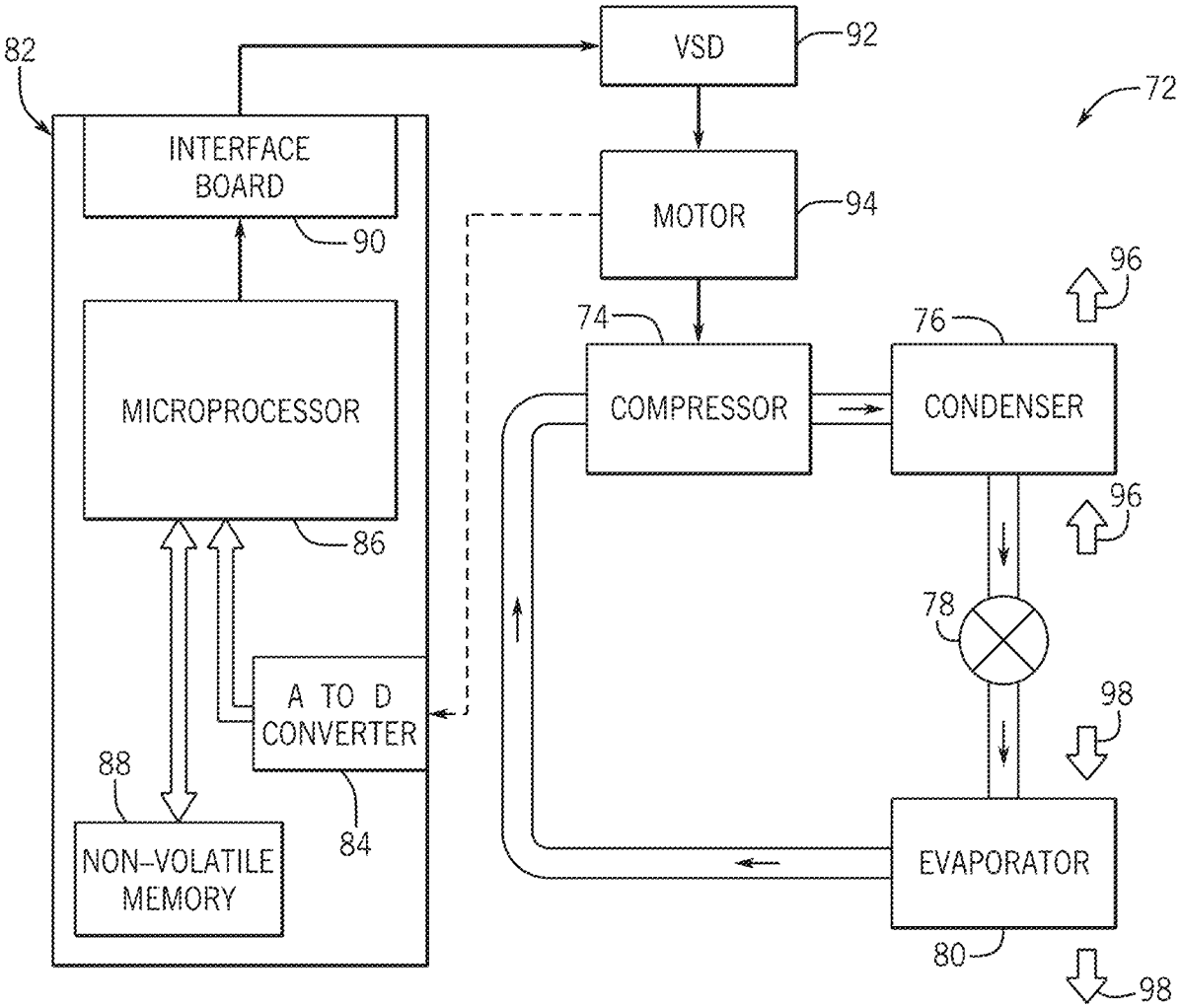
FIG. 4 is a schematic diagram of an embodiment of a vapor compression system used in an HVAC system, in accordance with an aspect of the present disclosure.

FIG. 4 is an embodiment of an embodiment of a vapor compression system 72 that can be used in any of the systems described above. The vapor compression system 72 may circulate a working fluid through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. In such embodiments, the vapor compression system 72 may not include the VSD 92. The motor 94 may include any type of electric motor that can be powered by a VSD or directly from an AC or DC power source, such as a switched reluctance motor, an induction motor, an electronically commutated motor, or another suitable motor.

The compressor 74 compresses a working fluid vapor and delivers the vapor to the condenser 76 through a discharge passage. In some embodiments, the compressor 74 may be a centrifugal compressor. The working fluid vapor delivered by the compressor 74 to the condenser 76 may transfer heat to a fluid passing across the condenser 76, such as ambient or environmental air 96. The working fluid vapor may condense to a working fluid liquid in the condenser 76 as a result of thermal heat transfer with the environmental air 96. The liquid working fluid from the condenser 76 may flow through the expansion device 78 to the evaporator 80.

The liquid working fluid delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid working fluid in the evaporator 80 may undergo a phase change from the liquid working fluid to a working fluid vapor. In this manner, the evaporator 80 may reduce the temperature of the supply air stream 98 via thermal heat transfer with the working fluid. Thereafter, the vapor working fluid exits the evaporator 80 and returns to the compressor 74 by a suction line to complete the cycle.

In some embodiments, the vapor compression system 72 may further include a reheat coil. In the illustrated embodiment, the reheat coil is represented as part of the evaporator 80. The reheat coil is positioned downstream of the evaporator heat exchanger relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As noted above, HVAC systems typically include a fan or blower configured to force or drive an air flow through the HVAC system. Unfortunately, conventional blowers are susceptible to various drawbacks, such as inefficient operation, increased energy consumption, complex power transmission configurations, costly assembly and manufacturing processes, and so forth. Accordingly, embodiments of the present disclosure are directed toward a blower assembly that is configured to operate more efficiently and enable manufacture and assembly with greater simplicity and reduced cost and time expense.

Figure 5:
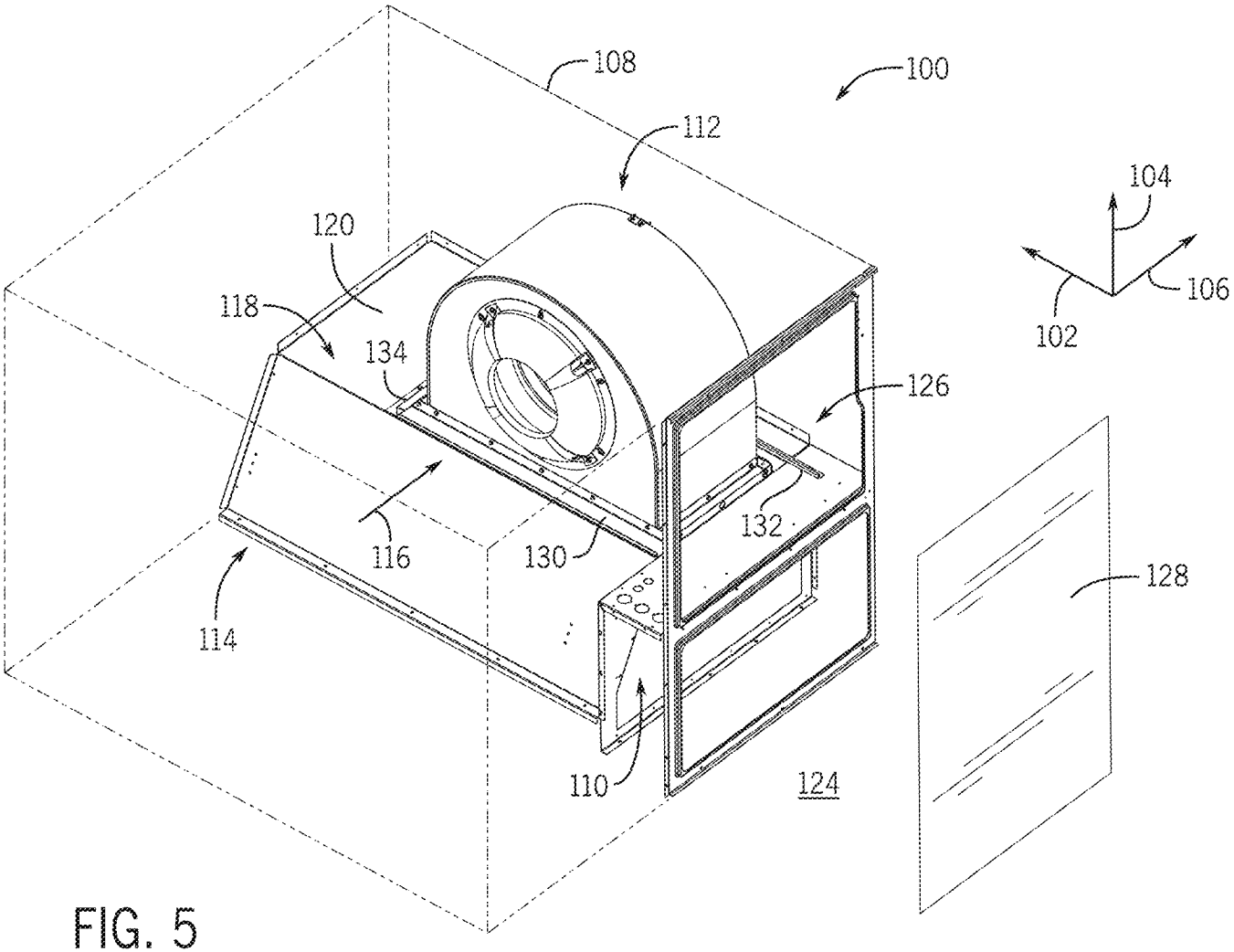
FIG. 5 is a perspective view of an embodiment of a portion of an HVAC system having a blower assembly, in accordance with an aspect of the present disclosure.

With the foregoing in mind, FIG. 5 is a perspective view of an embodiment of an HVAC system 100 that can be used in any suitable HVAC system (e.g., HVAC unit), such as the HVAC unit 12 of FIG. 1, the split, residential HVAC system 50 of FIG. 3, and/or the vapor compression system 72 of FIG. 4. Indeed, it should be noted that the HVAC system 100 may include embodiments and/or components of the HVAC unit 12, embodiments or components of the split, residential HVAC system 50, a rooftop unit (RTU), an air handler or air handling unit, an outdoor unit, and indoor unit, or any other suitable HVAC system. To facilitate discussion, the HVAC system 100 and components thereof may be described with reference to a longitudinal axis 102, a vertical axis 104, which is oriented relative to a direction of gravity, and a lateral axis 106.

In the illustrated embodiment, the HVAC system 100 includes a housing 108 configured to enclose and/or contain one or more components of the HVAC system 100, such as components of an embodiment of the vapor compression system 72. The housing 108 may be a housing of the HVAC unit 12, an air handling unit housing, a terminal unit housing, an indoor unit housing, an outdoor unit housing, a packaged unit housing, a rooftop unit housing, or any other suitable housing of the HVAC system 100. The housing 108 is configured to direct a flow of air across one or more heat exchange components of the HVAC system 100. For example, a heat exchanger 110 and a blower assembly 112 (e.g., fan assembly) may be disposed within an air flow path 114 defined by the housing 108, and the blower assembly 112 may be configured to direct an air flow 116 across the heat exchanger 110 to enable transfer of thermal energy (e.g., heat) between the air flow and the heat exchanger 110. The heat exchanger 110 may include a condenser, an evaporator, a furnace, a plurality of heat exchange tubes, a coil, another suitable type of heat exchanger, or any combination thereof. In some implementations, the blower assembly 112 is configured to direct the air flow 116 through the housing 108 and across the heat exchanger 110 to enable conditioning of the air flow. Additionally or alternatively, the blower assembly 112 may be configured to draw the air flow 116 into the housing 108, to discharge the air flow 116 from the housing 108, or both. The air flow 116 may enter the housing 108 as a pre-conditioned air flow, a return air flow, an ambient air flow, any combination thereof, or another suitable air flow. The air flow 116 discharged from the HVAC system 100 may be directed toward a conditioned space, such as via ductwork fluidly coupled to the air flow path defined by the housing 108.

In the illustrated embodiment, the HVAC system 100 also includes a platform 118 disposed within the housing 108. The platform 118 is configured to support the blower assembly 112 within the housing 108. For example, the platform 118 may include a support surface 120 configured to engage with the blower assembly 112 and support a weight of the blower assembly 112 (e.g., against a force of gravity along the vertical axis 104). The heat exchanger 110 may be positioned on a side of the platform 118 opposite the blower assembly 112 in an installed configuration of the blower assembly 112 within the housing 108. More specifically, in some embodiments the blower assembly 112 may be positioned atop the platform 118 (e.g., above the heat exchanger 110, relative to the vertical axis 104), and the heat exchanger 110 may be positioned below the platform 118 (e.g., relative to the vertical axis 104). As the blower assembly 112 is configured to force the air flow 116 across the heat exchanger 110, the platform 118 may include an air flow passage formed therein, and the blower assembly 112 may receive the air flow 116 and direct the air flow 116 through the air flow passage and across the heat exchanger 110 (e.g., along the vertical axis 104).

The blower assembly 112 and the housing 108 (e.g., platform 118) are configured to facilitate improved installation and enhanced serviceability of the blower assembly 112. For example, the blower assembly 112 may be readily accessible by an operator or technician from an environment 124 external to the housing 108 (e.g., ambient environment, surrounding environment). In the illustrated embodiment, the housing 108 defines an access opening 126 through which the blower assembly 112 may be installed within the housing 108, removed from the housing 108, and/or otherwise accessed by an operator from the environment 124. The housing 108 may also include an access panel 128 that may be moveably (e.g., pivotably, removably, slidingly) coupled to a remainder of the housing 108 to expose or occlude the access opening 126 of the housing 108. The blower assembly 112 may be installed within the housing 108 and removed from the housing 108 via removal of the access panel 128 from the housing 108 and without disassembly of other components (e.g., heat exchanger 110) disposed within the housing 108.

The blower assembly 112 and/or the platform 118 may also include one or more features configured to further facilitate improved installation and enhanced serviceability of the blower assembly 112. For example, the blower assembly 112 may include a base frame 130 configured engage with one or more components of the housing 108 (e.g., platform 118), such as one or more guide rails 132 coupled to the platform 118 (e.g., support surface 120) and/or a retention bracket 134 coupled to the platform 118 (e.g., support surface 120). The base frame 130, the guide rail 132, and the retention bracket 134 are described in further detail below. Additionally or alternatively, the blower assembly 112 may be manufactured, assembled, and operated with a reduced number of components (e.g., moving components, power transmission components) to enable more efficient operation of the blower assembly 112, in accordance with the present techniques. In this way, the blower assembly 112 may be manufactured, assembled, and serviced (e.g., maintained, repaired, replaced) at reduced costs, and the blower assembly 112 may operate with improved efficiency (e.g., reduced energy consumption, higher static pressure).

Figure 6:
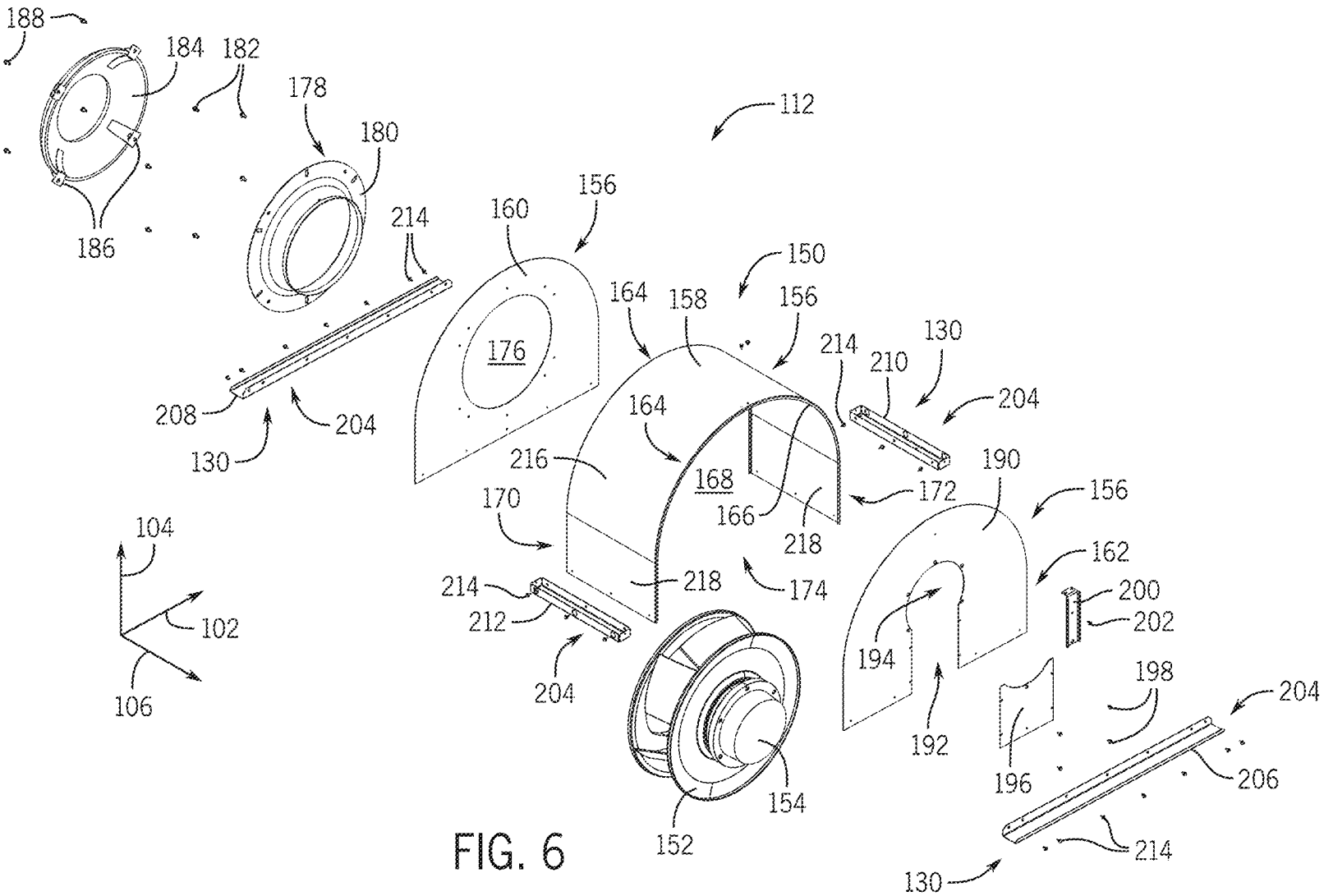
FIG. 6 is an exploded perspective view of an embodiment of a blower assembly, in accordance with an aspect of the present disclosure.

FIG. 6 is an exploded perspective view of an embodiment of the blower assembly 112 in accordance with the present techniques. The blower assembly 112 includes an enclosure 150, a fan wheel 152 (e.g., fan, blower, blower wheel, impeller, plenum fan, direct drive plenum fan) configured to be disposed within the enclosure 150, and a motor 154 configured to be mounted to the enclosure 150. The motor 154 may be directly coupled to the fan wheel 152 and may be configured to directly drive rotation of the fan wheel 152. For example, a shaft of the motor 154 may be directly coupled to the fan wheel 152. In other words, the blower assembly 112 may not include additional moving and/or power transmission components, such as one or more belts, gears, wheels, pulleys, sheaves, and/or other components, typically included with traditional blowers. Embodiments of the blower assembly 112 described herein may therefore operate with improved efficiency, reduced power consumption, reduced losses associated with additional power transmission components, and/or increased static pressure. The present techniques also enable manufacture, assembly, and maintenance of the blower assembly 112 more rapidly and at reduced costs (e.g., material costs). In some embodiments, the fan wheel 152 may be a backward curved fan (e.g., centrifugal fan). Additionally or alternatively, the motor 154 may be an electronically commutated motor (ECM) configured to drive rotation of the fan wheel 152 at variable speeds (e.g., each speed of a plurality of speeds). Indeed, it should be appreciated that the blower assembly 112 may be configured to operate at variable speeds without utilization of a variable frequency drive, which may further reduce costs associated with manufacture, assembly, operation, and/or maintenance of the blower assembly 112 and/or HVAC system 100.

The enclosure 150 may be an assembly or construction of a plurality of panels 156 (e.g., housing panels) coupled (e.g., attached, fixed, secured, directly coupled) to one another. In the illustrated embodiment, the plurality of panels 156 of the enclosure 150 includes a curved panel 158, a first side panel 160, and a second side panel 162. The first side panel 160 and the second side panel 162 may each be attached to opposite lateral sides or edges 164 of the curved panel 158. The plurality of panels 156 may be formed from any suitable material, such as a metallic material (e.g., sheet metal), a polymer, a composite, another suitable material, or any combination thereof. In some embodiments, the curved panel 158 and/or the first side panel 160 may be formed as a single piece panel (e.g., formed from a single piece of material). The plurality of panels 156 may be assembled to form the enclosure 150 in any suitable manner. For example, the first side panel 160 and the second side panel 162 (e.g., a main panel of the second side panel 162) may be attached to the lateral sides or edges 164 of the curved panel 158 via spot welding, brazing, or another joining technique. To this end, the curved panel 158 may include respective lips 166 extending from and along the lateral sides or edges 164 of the curved panel 158, and the first side panel 160 and the second side panel 162 may be spot welded and/or brazed to one of the lips 166. In other embodiments, the first side panel 160 and the second side panel 162 may be attached to the curved panel 158 via another suitable technique, such as an adhesive, one or more mechanical fasteners, and so forth.

In an assembled configuration, the enclosure 150 may define an internal volume 168 configured to receive and accommodate the fan wheel 152. In particular, the internal volume 168 may generally extend at least partially between the first side panel 160 and the second side panel 162 (e.g., along the lateral axis 106) and at least partially between a first end 170 (e.g., first longitudinal end) and a second end 172 (e.g., second longitudinal end) of the curved panel 158 (e.g., along the longitudinal axis 102). As described in further detail below, the plurality of panels 156 may also cooperatively define an air flow outlet 174 (e.g., open base) through which the blower assembly 112 may discharge an air flow (e.g., air flow 116) from the enclosure 150.

To receive and direct the air flow 116 into the enclosure 150 (e.g., internal volume 168), the first side panel 160 includes an air flow inlet 176 (e.g., a single air flow inlet of the enclosure 150) formed therein. That is, the air flow inlet 176 may be defined at least partially by an opening or aperture formed in the first side panel 160. The air flow 116 may be directed through the air flow inlet 176 and into the internal volume 168 of the enclosure 150 along the lateral axis 106. In some embodiments, the blower assembly 112 may include one or more additional components configured to enable improved flow of the air flow 116 into the internal volume 168 via the air flow inlet 176. For example, the blower assembly 112 may include an inlet flow guide 178 (e.g., inlet cone) coupled to the first side panel 160 external to the internal volume 168 of the enclosure 150. The inlet flow guide 178 may be disposed about (e.g., encircle) the air flow inlet 176. In some embodiments, at least a portion of the inlet flow guide 178 may extend into or through the air flow inlet 176 and/or into the internal volume 168. The inlet flow guide 178 may be configured to improve aerodynamic flow (e.g., efficiency) and/or to reduce noise (e.g., acoustic noise) output from the enclosure 150 during operation of the blower assembly 112. The inlet flow guide 178 may include an outer flange 180 configured to abut an external surface of the first side panel 160 to enable securement of the inlet flow guide 178 to the first side panel 160. The inlet flow guide 178 may be attached (e.g., coupled, removably coupled) to the first side panel 160 via a plurality of mechanical fasteners 182 and/or via another suitable manner. Use of mechanical fasteners 182 to secure the inlet flow guide 178 to the enclosure 150 may facilitate cost effective and more rapid assembly of the blower assembly 112.

Additionally or alternatively, the blower assembly 112 may include a flow grille 184 (e.g., flow grid) coupled to the first side panel 160 external to the internal volume 168 of the enclosure 150. The flow grille 184 may be disposed about (e.g., encircle) the air flow inlet 176 and may be configured to reduce turbulence in the air flow 116 and/or attenuate noise (e.g., acoustic noise) output from the enclosure 150 during operation of the blower assembly 112. To this end, the flow grille 184 may define a grid, lattice, and/or cross-hatched structure (e.g., dome structure) encircling the air flow inlet 176 external to the enclosure 150. The flow grille 184 may include one or more mounting tabs 186 configured to abut an external surface of the first side panel 160 to enable securement of the flow grille 184 to the first side panel 160. The flow grille 184 may be attached (e.g., coupled, removably coupled) to the first side panel 160 via a plurality of mechanical fasteners 188 and/or via another suitable manner. As will be appreciated, use of mechanical fasteners 188 to secure the flow grille 184 to the enclosure 150 may facilitate cost effective and more rapid assembly of the blower assembly 112.

To further achieve improved (e.g., more efficient, more rapid, more cost effective) manufacture, assembly, and/or serviceability of the blower assembly 112, the enclosure 150 is configured to enable installation of the fan wheel 152 and motor 154 within the enclosure 150 with substantially reduced modification and/or manipulation of the enclosure 150. For example, subsequent to assembly of the enclosure 150, the fan wheel 152 and the motor 154 may be directly coupled and/or mounted to another and may then be installed within the internal volume 168 of the enclosure 150. In other words, the plurality of panels 156 (e.g., curved panel 158, first side panel 160, main panel of second side panel 162) may be secured to one another to define the internal volume 168, and the fan wheel 152 and the motor 154 may be collectively assembled with the enclosure 150.

The fan wheel 152 may be positioned within the internal volume 168 via the air flow outlet 174 defined via the plurality of panels 156. To enable concurrent positioning of the motor 154, the second side panel 162 includes a main panel 190 (e.g., main side panel) defining a slot 192 (e.g., cutout, passage, channel) configured to enable translation of at least a portion of the motor 154 therethrough and an opening 194 configured to accommodate at least a portion of the motor 154 in an assembled configuration of the blower assembly 112. For example, subsequent to assembly of the curved panel 158, the first side panel 160, and the main panel 190 of the second side panel 162, the fan wheel 152 and the motor 154 (e.g., directly attached to one another) may be translated (e.g., along the vertical axis 104 in the illustrated embodiment) into an assembled configuration with the enclosure 150. That is, the fan wheel 152 may be translated (e.g., along the vertical axis 104) into the internal volume 168 via the air flow outlet 174, and at least a portion of the motor 154 may be simultaneously translated (e.g., along the vertical axis 104) within (e.g., along, through) the slot 192 until the motor 154 (e.g., a rotational axis of a shaft of the motor 154) is aligned (e.g., coaxial) with the opening 194 (e.g., along the lateral axis 106). Thereafter, the motor 154 may be attached and/or mounted to the main panel 190 of the second side panel 162 external to the internal volume 168 of the enclosure 150. For example, the motor 154 may be removably mounted to the second side panel 162 (e.g., main panel 190) via mechanical fasteners, such as screws, nuts, bolts, rivets, or any other suitable mechanical fasteners. In the assembled configuration, a shaft of the motor 154 may extend from a portion of the motor 154 external to the enclosure 150, through the opening 194, and to the fan wheel 152 within the internal volume 168.

With the motor 154 mounted to the enclosure 150 and the fan wheel 152 positioned within the internal volume 168 of the enclosure 150, a cover panel 196 of the second side panel 162 may be attached (e.g., directly attached, removably coupled) to the main panel 190 of the second side panel 162 to occlude (e.g., overlap with) the slot 192 (e.g., along the lateral axis 106). The cover panel 196 may be removably coupled to the main panel 190 of the second side panel 162 via mechanical fasteners 198, such as screws, nuts, bolts, rivets, or any other suitable mechanical fasteners. Thus, the enclosure 150 may be substantially enclose the fan wheel 152 while also defining the air flow inlet 176 configured to receive the air flow 116 and the air flow outlet 174 configured to discharge the air flow 116 from the blower assembly 112. Incorporation of the cover panel 196 to occlude the slot 192 of the main panel 190 may block flow of the air flow 116 out of the enclosure 150 in an undesired direction or manner. In some embodiments, the cover panel 196 may also be removably coupled to the motor 154 via one or more of the mechanical fasteners 198. It should be appreciated that the fan wheel 152 and the motor 154 may be similarly removed from the enclosure 150 with substantially reduced modification and/or disassembly of the enclosure 150. For example, in some instances the blower assembly 112 may be removed or partially removed from the housing 108 of the HVAC system 100, the cover panel 196 may be detached from the main panel 190 of the second side panel 162, and the fan wheel 152 and the motor 154 may be detached from the enclosure 150 without further disassembly of the enclosure 150. In some embodiments, the motor 154 may be accessed, serviced, and/or otherwise maintained without removal from the enclosure 150. At least a portion of the motor 154 may remain external to the enclosure 150 in an assembled configuration of the blower assembly 112, and internal components of the motor 154 (e.g., a motor controller, control circuitry) may be accessed via removal of a cover plate or housing portion of the motor 154 to perform maintenance on the motor 154 with the motor 154 and the fan wheel 152 assembled with the enclosure 150. In some instances, such maintenance on the motor 154 (e.g., motor controller) may be performed with the blower assembly 112 installed (e.g., not removed or partially removed) within the enclosure 108 of the HVAC system 100.

In the illustrated embodiment, the blower assembly 112 further includes a support bracket 200 (e.g., L-shaped bracket, stiffener bracket) configured to be attached (e.g., removably coupled) to the curved panel 158, the main panel 190 of the second side panel 162, and the motor 154, such as via mechanical fasteners 202. The support bracket 200 may enhance a structural rigidity and/or stiffness of the blower assembly 112 in the assembled configuration. Additionally or alternatively, in some embodiments, the support bracket 200 may be configured to at least partially support a weight of the motor 154 and/or the fan wheel 152 attached to the motor 154 in the assembled configuration of the blower assembly 112.

As mentioned above, the blower assembly 112 may also include the base frame 130 configured to facilitate improved installation and enhanced serviceability of the blower assembly 112. The base frame 130 may also be configured to provide increased structural support for the blower assembly 112. In the illustrated embodiment, the base frame 130 includes a plurality of rails 204 configured to be coupled to one another and/or to the enclosure 150. In an assembled configuration, the plurality of rails 204 may extend generally about a perimeter of the enclosure 150 (e.g., the plurality of panels 156), such as generally about a perimeter of the air flow outlet 174.

As shown, the base frame 130 includes a first side rail 206 (e.g., first lateral side rail, mounting rail) configured to be secured (e.g., removably coupled) to the second side panel 162 (e.g., main panel 190 and/or cover panel 196) and a second side rail 208 (e.g., second lateral side rail, mounting rail) configured to be secured (e.g., removably coupled) to the first side panel 160. The first side rail 206 and the second side rail 208 may extend along the longitudinal axis 102 in an assembled configuration. The base frame 130 also includes a first end rail 210 (e.g., inner end rail) configured to be secured (e.g., removably coupled) to the second end 172 of the curved panel 158 and a second end rail 212 (e.g., outer end rail) configured to be secured (e.g., removably coupled) to the first end 170 of the curved panel 158. The first end rail 210 and the second end rail 212 extend cross-wise to and between the first side rail 206 and the second side rail 208. The first end rail 210 and the second end rail 212 may extend along the lateral axis 106 in an assembled configuration.

The plurality of rails 204 may be secured to one or more of the panels 156 of the enclosure 150 and/or to one another via one or more mechanical fasteners 214 (e.g., nuts, bolts, screws, rivets, etc.) to enable more rapid and/or more cost effective manufacturing, assembly, and/or maintenance of the blower assembly 112. In accordance with the present techniques, the fan wheel 152 and the motor 154 may be removed from the enclosure 150 in the manner described above and without disassembly of the base frame 130 from the enclosure 150. As a result, maintenance, servicing, repair, and/or replacement of the fan wheel 152 and/or the motor 154 may be performed without substantial modification and/or disassembly of the enclosure 150 and/or other components of the blower assembly 112. Additional features and functionality of the base frame 130 are described further below.

It should be appreciated that the blower assembly 112 may include features and/or modifications in addition to and/or instead of those described herein. For example, the curved panel 158 may have a curved portion 216 (e.g., curved surface) without planar or linear portions. The curved portion 216 may have a constant radius of curvature, in some embodiments, which may enable more efficient and/or cost-effective manufacturing of the curved panel 158. For example, the curved portion 216 may have a semi-circular configuration, profile, and/or shape. A center of the radius of curvature of the curved panel 158 may be coaxial with a rotational axis of the fan wheel 152. In other embodiments, the fan wheel 152 may be eccentrically mounted within the enclosure 150, such that the rotational axis of the fan wheel 152 is offset from the center of the radius of curvature of the curved panel 158. In further embodiments, the curved panel 158 may have one or more curved portions 216 or surfaces, multiple continuous curved portions with different radii of curvature, multiple discontinuous or segmented curved portions 216, and so forth. Further, in some embodiments, the curved panel 158 may include the curved portion 216 (e.g., having a constant radius of curvature), as well respective linear (e.g., planar) or straight portions 218 (e.g., linear panels, additional panels, planar panels, linear extensions) extending from each of the first end 170 and the second end 172 of the curved panel 158 (e.g., along the vertical axis 104). The linear portions 218 may be incorporated based on one or more design characteristics of the fan wheel 152 (e.g., a size of the fan wheel 152) one or more operating parameters of the blower assembly 112 and/or the HVAC system 100, desired efficiency of the blower assembly 112 in certain operating conditions, another suitable factor or parameter, or any combination thereof.

Figure 7:
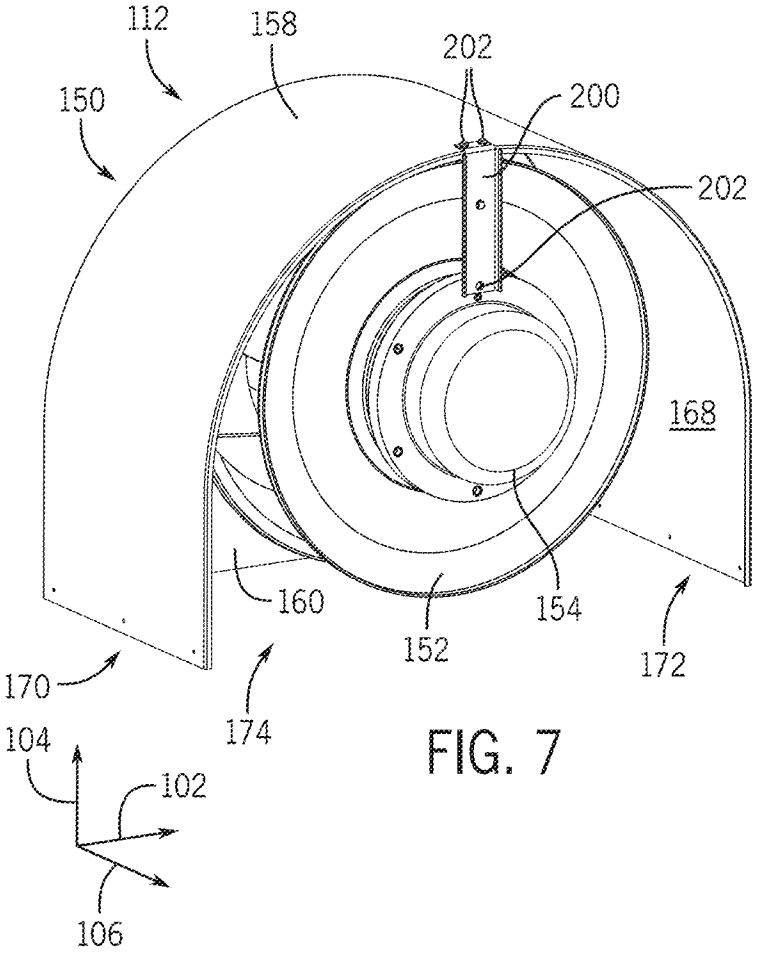
FIG. 7 is a perspective view of an embodiment of a portion of a blower assembly in an assembled configuration, in accordance with an aspect of the present disclosure.

FIG. 7 is a perspective view of a portion of an embodiment of the blower assembly 112, illustrating various components of the blower assembly 112 in an assembled configuration. The illustrated embodiment includes similar elements and element numbers as those described above with reference to FIG. 6. The curved panel 158 and the first side panel 160 are assembled together (e.g., directly secured to one another) to at least partially define the internal volume 168 of the enclosure 150, and the fan wheel 152 and the motor 154 directly coupled thereto are shown in an assembled configuration or arrangement with components of the enclosure 150. The second side panel 162 is omitted for clarity and to better illustrate the fan wheel 152 disposed within the internal volume 168 in the assembled configuration.

As mentioned above, some embodiments of the blower assembly 112 may include the support bracket 200 configured to mount to the curved panel 158 and the motor 154 via mechanical fasteners 202 (e.g., screws, bolts, pins, etc.). In this way, the support bracket 200 may at least partially support a weight of the motor 154 and/or the fan wheel 152. In particular, the support bracket 200 may transfer at least a portion of the weight of the motor 154 and/or the fan wheel 152 to the curved panel 158 (e.g., the enclosure 150), which may further transfer a force induced via the weight to the platform 118 or other component of the HVAC system 100 to which the blower assembly 112 is coupled.

Figure 8:
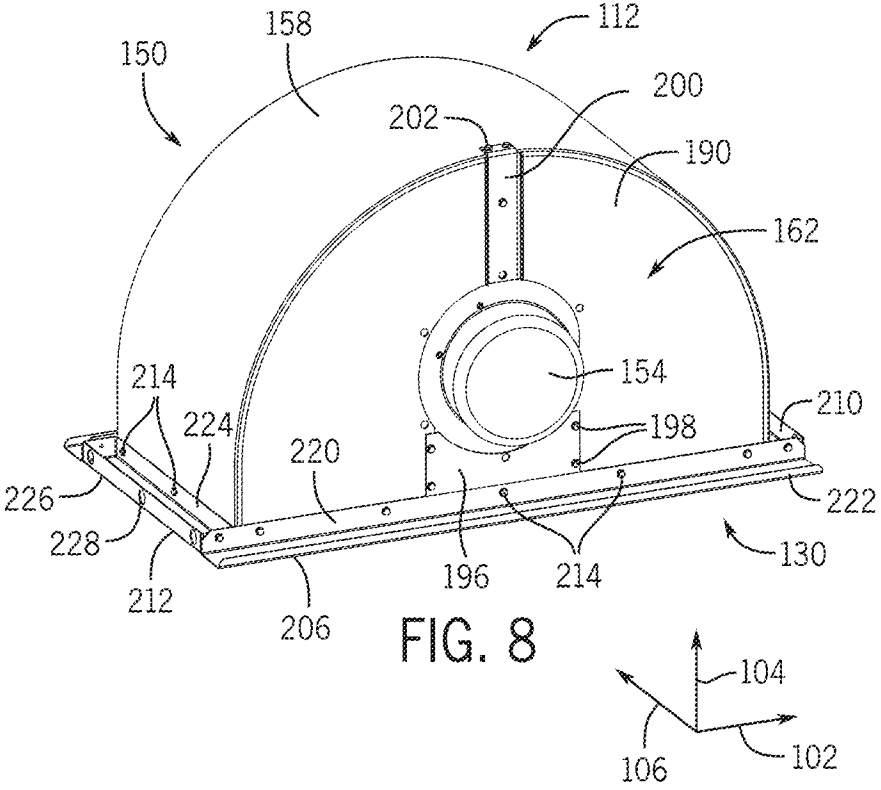
FIG. 8 is a perspective view of an embodiment of a blower assembly in an assembled configuration, in accordance with an aspect of the present disclosure.

FIG. 8 is a perspective view of an embodiment of the blower assembly 112, illustrating an assembled configuration of the blower assembly 112. That is, the enclosure 150 is formed via assembly of the plurality of panels 156 (e.g., curved panel 158, first side panel 160, second side panel 162) to define the internal volume 168 accommodating the fan wheel 152 disposed therein. The motor 154 directly coupled to the fan wheel 152 is disposed at least partially within the opening 194 formed in the main panel 190 of the second side panel 162 to occlude the opening 194 and block inadvertent and/or undesired discharge of the air flow 116 via a space or gap formed between the second side panel 162 and the motor 154. Additionally, the cover panel 196 is removably attached to the main panel 190 to occlude the slot 192 formed within the main panel 190. In this way, the cover panel 196 may further block inadvertent and/or undesired discharge of the air flow 116 from the internal volume 168 via the slot 192, thereby enabling reliable discharge of the air flow 116 via the air flow outlet 174.

The illustrated embodiment also includes the base frame 130 assembled with the enclosure 150. The base frame 130 includes embodiments of the plurality of rails 204 described above with reference to FIG. 6. In some embodiments, the first side rail 206 and the second side rail 208 may each have a similar configuration and/or may be a common embodiment utilized as both the first side rail 206 and the second side rail 208. Similarly, the first end rail 210 and the second end rail 212 may each have a similar configuration and/or may be a common embodiment utilized as both the first side rail 206 and the second side rail 208. In this way, costs associated with manufacture and assembly of the blower assembly 112 may be further reduced.

As shown, the first side rail 206 and/or the second side rail 208 may include and/or define a channel configuration or shape having a mounting flange 220 configured to be attached (e.g., removably coupled) to the enclosure 150 (e.g., one or more panels 156) and/or to other rails 204 of the base frame 130 (e.g., via mechanical fasteners 214). The first side rail 206 and/or the second side rail 208 may include a retention flange 222 (e.g., extending along the vertical axis 104) at an offset distance from the enclosure 150. Thus, in some embodiments, the first side rail 206 and/or the second side rail 208 may be a C-channel component. As described in further detail below, the retention flange 222 may be configured to extend within, translate along, and/or be retained by one of the guide rails 132 attached to the platform 118 to facilitate improved installation and removal of the blower assembly 112 from the housing 108, as well as improved retention of a position and/or orientation of the blower assembly 112 within the housing 108 in the installed configuration of the blower assembly 112.

Additionally or alternatively, one or both of the first end rail 210 and the second end rail 212 may have a mounting flange 224 configured to be attached (e.g., removably coupled) to the enclosure 150 (e.g., one or more panels 156) and/or to other rails 204 of the base frame 130 (e.g., via mechanical fasteners 214). An outer flange 226, opposite the mounting flange 224, may include apertures 228 (e.g., enlarged apertures) configured to accommodate positioning and actuation of a tool (e.g., a hand tool, a drill bit) therein to facilitate securement of the mounting flange 224 to the enclosure 150 via one or more of the mechanical fasteners 214. The second end rail 212 may also define a trough-shaped configuration (e.g., grip) configured to function as a handle that may be utilized to manually translate (e.g., linearly translate) the blower assembly 112 between an installed configuration within the housing 108 and an uninstalled configuration. As described in further detail below, the first end rail 210 may be received via a recess of the retention bracket 134 attached to the platform 118 to enable desired positioning of the blower assembly 112 in the installed configuration, as well as retention of the blower assembly 112 (e.g., relative to the vertical axis 104 and/or the longitudinal axis 102) in the installed configuration.

Figure 9:
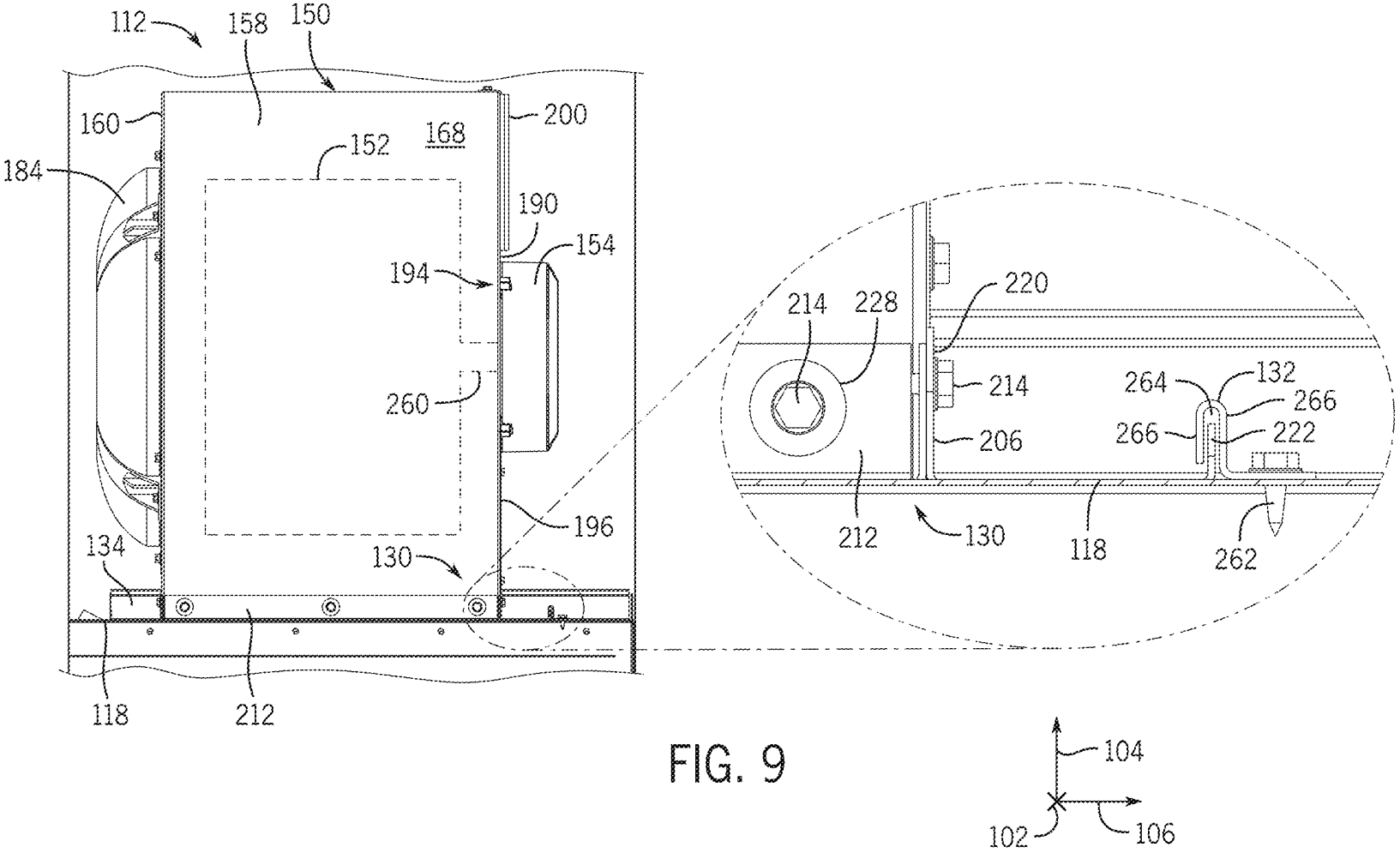
FIG. 9 is a side view of an embodiment of a blower assembly in an installed configuration within an HVAC system, in accordance with an aspect of the present disclosure.

FIG. 9 is a side view of an embodiment of the blower assembly, illustrating the blower assembly 112 in an installed configuration within the housing 108 of the HVAC system 100. The illustrated embodiment includes similar elements and element numbers as those discussed above. In the installed configuration, the blower assembly 112 may be positioned atop the platform 118 within the housing 108. As described above, in the assembled configuration, the fan wheel 152 is positioned within the internal volume 168 of the enclosure 150, the motor 154 is mounted (e.g., externally mounted) to the second side panel 162 of the enclosure 150, and a shaft 260 of the motor 154 extends through the opening 194 formed in the second side panel 162 and is directly attached to the fan wheel 152.

The illustrated embodiment also shows engagement between the first side rail 206 of the base frame 130 and the guide rail 132 attached to the platform 118. As discussed above, the first side rail 206 includes the mounting flange 220 secured to the second side panel 162 and the retention flange 222 offset from the enclosure 150 (e.g., along the lateral axis 106) and extending along the vertical axis 104. The guide rail 132 is attached to the support surface 120 of the platform 118, such as via one or more mechanical fasteners 262. The guide rail 132 also defines a retention slot 264 via two retention portions 266 of the guide rail 132 extending generally along the vertical axis 104. Thus, the retention slot 264 also generally extends along the vertical axis 104. The retention slot 264 may also generally extend along the longitudinal axis 102. During installation of the blower assembly 112 within the housing 108, the retention flange 222 of the first side rail 206 may be aligned within the retention slot 264 along the longitudinal axis 102 (e.g., between the retention portions 266, relative to the lateral axis 106), and the blower assembly 112 may be translated (e.g., pushed) along the longitudinal axis 102 (e.g., in a linear direction) such that the retention flange 222 extends within the retention slot 264 and between the retention portions 266 of the guide rail 132.

As the blower assembly is further translated into the housing 108 and along the platform 118, the guide rail 132 (e.g., retention portions 266) may retain the retention flange 222 within the retention slot 264 and guide the blower assembly 112 linearly toward the installed configuration within the housing 108. In this way, the blower assembly 112 may be readily and reliably transitioned (e.g., pushed) into the installed configuration and into a desired position and/or orientation within the housing 108 (e.g., atop the platform 118). Similarly, to transition the blower assembly 112 from the installed configuration within the housing 108 to an uninstalled configuration, the second end rail 212 of the base frame 130 may be gripped (e.g., via the trough configuration of the second end rail 212) by an operator or technician and pulled along the longitudinal axis 102 to remove and/or otherwise access the blower assembly 112 and the components thereof.

It should be appreciated that the platform 118 may include another guide rail 132 (e.g., an additional guide rail, a second guide rail) corresponding to the second side rail 208 of the base frame 130 and configured to receive, guide, and retain the retention flange 222 of the second side rail 208 to further enable desired alignment and translation of the blower assembly 112 between the uninstalled configuration and the installed configuration. In some embodiments of the platform 118 having two guide rails 132 corresponding to the first side rail 206 and the second side rail 208, the two guide rails 132 may have different lengths (e.g., extending along the longitudinal axis 102) to provide desired alignment and translation of the blower assembly 112 along the platform 118 while also avoiding undesired resistance (e.g., friction) imparted to the blower assembly 112 via the guide rails 132 during translation of the blower assembly.

Figure 10:
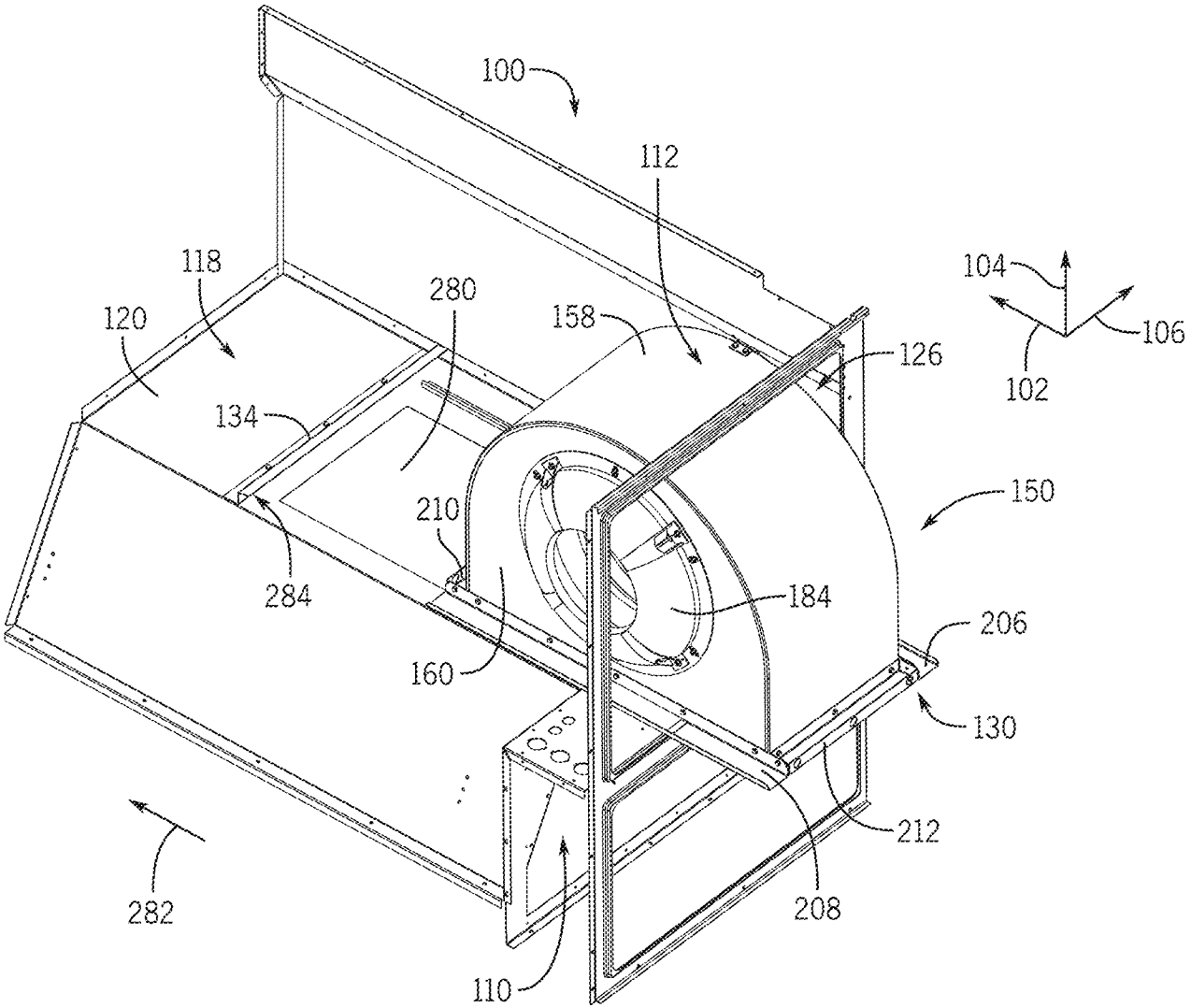
FIG. 10 is a perspective view of an embodiment of a portion of an HVAC system, illustrating installation of an embodiment of a blower assembly, in accordance with an aspect of the present disclosure.
Figure 11:
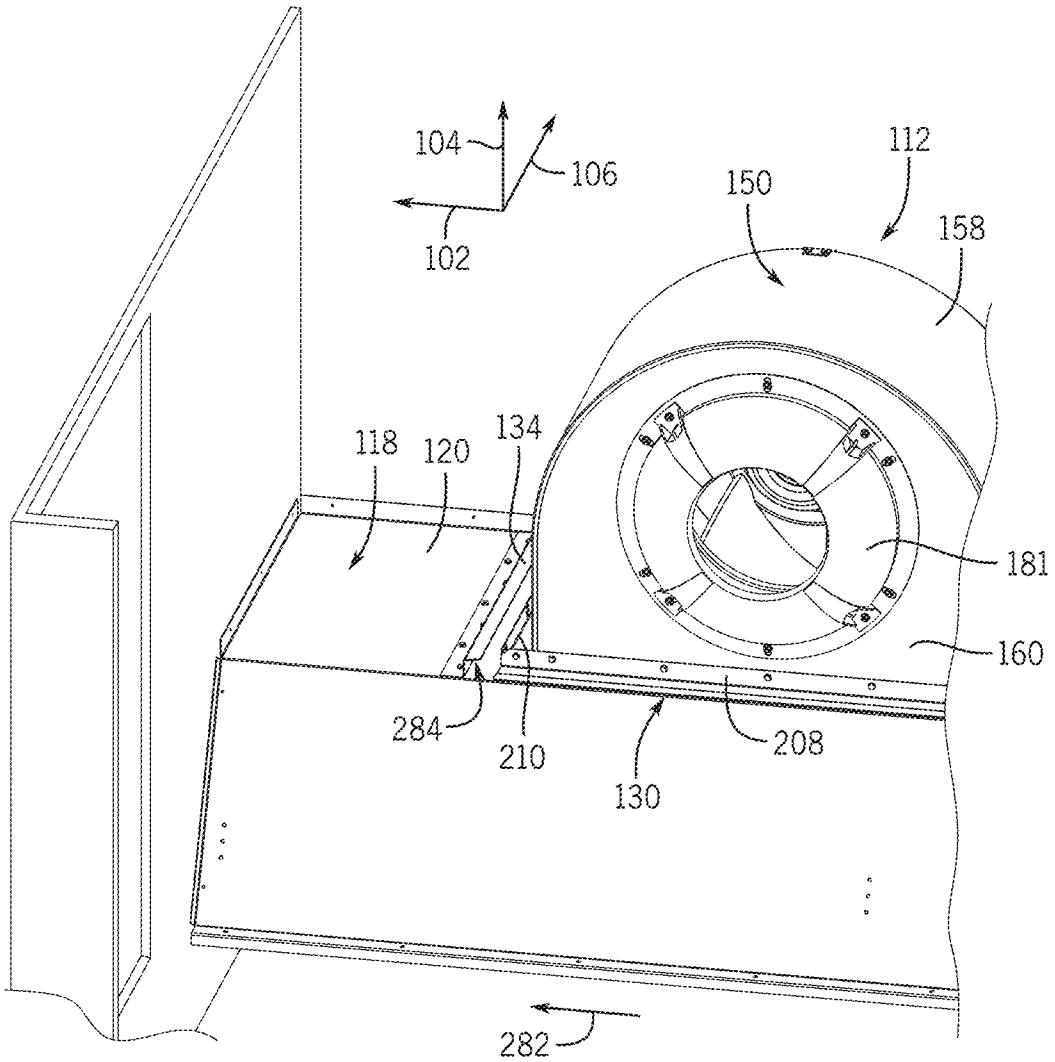
FIG. 11 is a perspective view of an embodiment of a portion of an HVAC system, illustrating installation of an embodiment of a blower assembly, in accordance with an aspect of the present disclosure.

FIGS. 10 and 11 are perspective views of a portion of the HVAC system 100, illustrating transition of the blower assembly 112 from an uninstalled configuration to an installed configuration within the housing 108 of the HVAC system 100. The illustrated embodiment includes similar elements and element numbers as those described above. FIGS. 10 and 11 are described concurrently below.

The blower assembly 112 may be positioned atop the platform 118 within the housing 108 in the installed configuration of the blower assembly 112. As mentioned above, the platform 118 may include an air flow passage 280 formed therein to enable discharge of the air flow 116 from the blower assembly 112 and across the heat exchanger 110, which may be positioned below the platform 118, relative to the vertical axis 104. As will be appreciated, it is desirable to ensure that the blower assembly 112 is positioned along the platform 118 such that the air flow outlet 174 of the enclosure 150 is aligned (e.g., substantially overlapping with, aligned relative to the lateral axis 106 and the longitudinal axis 102) with the air flow passage 280.

While the one or more guide rails 132 are configured to engage with one or more retention flanges 222 of the first side rail 206 and/or the second side rail 208, the platform 118 further includes the retention bracket 134 configured to engage with the first end rail 210 to enable desired positioning of the blower assembly 112 along the longitudinal axis 102 and thereby ensure alignment of the air flow outlet 174 with the air flow passage 280 of the platform 118. To this end, the retention bracket 134 is disposed on a side of the air flow passage 280 opposite the access opening 126. As the blower assembly 112 is translated along the longitudinal axis 102 and into the installed configuration (e.g., in a linear direction 282), the first end rail 210 may ultimately be received within a retention recess 284 formed via the retention bracket 134. The retention bracket 134 may capture the first end rail 210 within the retention recess 284 and block further translation of the blower assembly 112 in the linear direction 282. Accordingly, the retention bracket 134 may be attached to the platform 118 at a position or location that coincides with concurrent abutment between the retention bracket 134 and the first end rail 210, as well as alignment (e.g., along the longitudinal axis 102, along the vertical axis 104) of the air flow outlet 174 and the air flow passage 280. Once the blower assembly 112 is in the installed configuration within the housing 108 (e.g., the first end rail 210 is received and/or captured within the retention bracket 134), mechanical fasteners (e.g., screws) may be utilized to secure the second end rail 212 to the platform 118 (e.g., screws extending through the second end rail 212 and the platform 118). In this way, the blower assembly 112 may be readily installed and reliably positioned within the housing 108 in a desired orientation by an operator located within the environment 124 external to the housing 108 of the HVAC system 100.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A blower assembly for a heating, ventilation, and air conditioning (HVAC) system, comprising:

an enclosure comprising a curved panel, a first side panel attached to the curved panel, and a second side panel attached to the curved panel, wherein the curved panel, the first side panel, and the second side panel cooperatively define an air flow outlet of the blower assembly;

a fan wheel disposed within the enclosure;

a motor mounted to the second side panel, wherein the motor comprises a shaft, and the fan wheel is directly mounted to the shaft; and a base frame coupled to the enclosure, wherein the base frame is configured to translate along a platform of the HVAC system to transition the blower assembly from an uninstalled configuration to an installed configuration, and the base frame is configured to engage with the platform to retain an orientation of the blower assembly within the HVAC system in the installed configuration, wherein the base frame comprises a side rail attached to the second side panel, the side rail comprises a retention flange, and the retention flange is configured to extend within a retention slot of a guide rail of the platform in the installed configuration.

2. The blower assembly of claim 1, wherein the base frame comprises an end rail attached to the side rail and to the curved panel, the end rail extends cross-wise to the side rail, and the end rail is configured to extend within a retention recess of a retention bracket of the platform in the installed configuration.

3. The blower assembly of claim 1, wherein the retention flange is configured to translate linearly within the retention slot of the guide rail during transition of the blower assembly between the uninstalled configuration and the installed configuration.

4. The blower assembly of claim 1, wherein the second side panel comprises:

a main panel comprising a slot and an opening formed therein; and a cover panel configured to removably couple to the main panel and occlude the slot, wherein the motor is configured to occlude the opening and the shaft is configured to extend through the opening in an assembled configuration of the blower assembly, and the motor is removable from the enclosure via the slot.

5. The blower assembly of claim 4, wherein the cover panel is configured to couple to the motor in the assembled configuration of the blower assembly.

6. The blower assembly of claim 1, wherein the motor is an electronically commutated motor configured to drive rotation of the fan wheel at variable speeds.

7. The blower assembly of claim 6, wherein the fan wheel is a backward curved fan.

8. The blower assembly of claim 1, wherein the curved panel comprises a constant radius of curvature.

9. The blower assembly of claim 1, comprising a support bracket attached to the second side panel, the curved panel, and the motor, wherein the support bracket is configured to at least partially support a weight of the motor and the fan wheel.

10. The blower assembly of claim 1, wherein the first side panel comprises an air flow inlet formed therein, and the blower assembly comprises:

an inlet flow guide attached to the first side panel and extending at least partially within the air flow inlet:

a flow grid attached to the first side panel and extending about the air flow inlet; or both.

11. A blower assembly for a heating, ventilation, and air conditioning (HVAC) system, comprising:

a fan wheel;

a motor directly coupled to the fan wheel and configured to drive rotation of the fan wheel; and an enclosure comprising a first side panel, a second side panel, and a curved panel extending from the first side panel to the second side panel to define an internal volume of the enclosure, wherein the first side panel comprises an air inlet opening formed therein, the second side panel comprises a main panel and a cover panel configured to removably couple to the main panel, the main panel comprises an opening and a slot formed therein, the motor is configured to be disposed at least partially within the opening and to mount to the second side panel in an assembled configuration of the blower assembly, the cover panel is configured to occlude the slot in the assembled configuration, and the motor and the fan are removable from the enclosure via the slot, comprising a side rail attached to the second side panel, wherein the side rail comprises retention flange configured to linearly translate within a retention slot of a guide rail of the HVAC system during installation and removal of the blower assembly, and the retention flange is configured to be retained within the guide rail in an installed configuration of the blower assembly with the HVAC system.

12. The blower assembly of claim 11, comprising an end rail attached to the curved panel, wherein the end rail is configured to extend within a retention recess of a retention bracket of HVAC system in the installed configuration.

13. The blower assembly of claim 12, wherein the side rail is a first side rail, the end rail is a first end rail, and the blower assembly comprises:

a second side rail attached to the first side panel; and a second end rail attached to the curved panel, opposite the first end rail, relative to the internal volume, wherein the first side rail, the second side rail, the first end rail, and the second end rail extend about an air flow outlet of the enclosure, and the air flow outlet is cooperatively defined by the first side panel, the second side panel, and the curved panel.

14. The blower assembly of claim 13, wherein the first side rail, the second side rail, the first end rail, and the second end rail are attached to the enclosure and to one another via a plurality of mechanical fasteners.

15. The blower assembly of claim 14, wherein the fan wheel is a backward curved fan, and the motor is an electronically commutated motor.

16. A heating, ventilation, and air conditioning (HVAC) system, comprising:

a housing defining an air flow path therethrough;

a platform disposed within the housing, wherein the platform comprises a guide rail attached to a support surface of the platform; and a blower assembly configured to be disposed within the housing, wherein the blower assembly comprises an enclosure, a fan wheel disposed within the enclosure, and a motor directly coupled to the fan wheel and mounted to the enclosure, wherein the enclosure comprises a curved panel, a first side panel attached to the curved panel, a second side panel attached to the curved panel, and a side rail attached to the second side panel, and the side rail comprises a retention flange, and wherein the blower assembly is configured to translate in a linear direction and along the platform from an uninstalled configuration to an installed configuration within the housing and atop the support surface of the platform, the retention flange is configured to translate within and along a retention slot of the guide rail, in the linear direction, during transition of the blower assembly from the uninstalled configuration to the installed configuration, and the guide rail is configured to engage with the retention flange to restrict movement of the enclosure of the blower assembly within the housing in the installed configuration.

17. The HVAC system of claim 16, wherein the second side panel comprises:

a main panel comprising a slot and an opening formed therein; and a cover panel configured to removably couple to the main panel and occlude the slot in an assembled configuration of the blower assembly, wherein the motor is configured to occlude the opening in the assembled configuration, and the motor and the fan wheel are collectively removable from the enclosure via the slot.

18. The HVAC system of claim 16, wherein the platform comprises a retention bracket attached to the support surface of the platform, the retention bracket defines a retention recess, the enclosure comprises an end rail attached to the curved panel, the retention recess is configured to receive the end rail, and the retention bracket is configured to restrict movement of the enclosure of the blower assembly within the housing in the installed configuration.

* * * * *